US012072173B2

(12) United States Patent
Pedicini et al.

(10) Patent No.: US 12,072,173 B2
(45) Date of Patent: Aug. 27, 2024

(54) PROJECTILE CONSTRUCTION, LAUNCHER, AND LAUNCHER ACCESSORY

(71) Applicant: NL Enterprises, LLC, Cheyenne, WY (US)

(72) Inventors: Christopher Pedicini, Brentwood, TN (US); Joshua Pedicini, Nashville, TN (US); Cole Huner, Thompson's Station, TN (US)

(73) Assignee: NL Enterprises LLC, Cheyenne, WY (US)

( * ) Notice: Subject to any disclaimer, the term of this patent is extended or adjusted under 35 U.S.C. 154(b) by 0 days.

(21) Appl. No.: 18/078,028

(22) Filed: Dec. 8, 2022

(65) Prior Publication Data

US 2023/0324154 A1 Oct. 12, 2023

Related U.S. Application Data

(60) Provisional application No. 63/287,265, filed on Dec. 8, 2021.

(51) Int. Cl.
*F42B 6/00* (2006.01)
*F41B 6/00* (2006.01)

(52) U.S. Cl.
CPC ..... *F42B 6/006* (2013.01); *F41B 6/00* (2013.01)

(58) Field of Classification Search
CPC ..... F42C 17/04; F42C 11/065; F42C 11/001; F42C 9/00; F42B 6/006; F42B 6/00; F42B 6/003; F42B 12/50; F42B 12/367; F42B 12/46; F42B 12/40
See application file for complete search history.

(56) References Cited

U.S. PATENT DOCUMENTS 1,739,921 A * 12/1929 Gietmann ..... F42C 11/04 102/209
3,958,510 A * 5/1976 Stutzle ..... F42C 17/04 102/209
4,019,439 A * 4/1977 Beuchat ..... F42C 11/00 102/209
4,022,102 A * 5/1977 Ettel ..... F42C 11/065 89/1.1
4,649,796 A * 3/1987 Schmidt ..... F42C 17/04 324/179
5,698,815 A * 12/1997 Ragner ..... F41H 13/0006 102/504
7,316,562 B2 * 1/2008 Trefall ..... F23G 7/08 102/206

(Continued)

*Primary Examiner* — Joshua E Freeman
(74) *Attorney, Agent, or Firm* — Jay Schloff; Aidenbaum Schloff and Bloom PLLC

(57) ABSTRACT

A projectile includes a projectile housing with at least one compartment, an energizable energy storage means, a payload, a control circuit, and an initiator. The payload may be sequestered in one compartment of the projectile until the projectile is separated or opened. A ram element within the projectile may move within the projectile to cause the opening of a projectile. The projectile may include a means for activating the initiator via dynamic induction. In an example embodiment, the projectile comprises a coil that is operatively coupled to a magnetic element of a launcher. The projectile may be charged dynamically as via interaction between the coil and magnetic element as the projectile moves within the launcher.

6 Claims, 12 Drawing Sheets

(56) References Cited

U.S. PATENT DOCUMENTS

| | | | | |
|---|---|---|---|---|
| 8,256,351 | B1 * | 9/2012 | Kramer | F42C 11/065 102/370 |
| 8,490,533 | B2 * | 7/2013 | Reynard | F42C 11/04 89/6 |
| 8,746,119 | B2 * | 6/2014 | Frick | F41G 9/00 89/6 |
| 8,985,000 | B2 * | 3/2015 | Frick | F42C 11/008 102/209 |
| 9,423,226 | B2 * | 8/2016 | Cillaut | F42B 12/62 |
| 2020/0109931 | A1 * | 4/2020 | Pedicini | F42C 11/06 |

* cited by examiner

PROJECTILE CONSTRUCTION, LAUNCHER, AND LAUNCHER ACCESSORY

CROSS-REFERENCE TO RELATED APPLICATIONS

The present application is a non-provisional application of and claims priority under 35 U.S.C. § 119 on pending U.S. Provisional Patent Application Ser. No. 63/287,265, filed on Dec. 8, 2021, the disclosure of which is incorporated by reference.

FIELD OF THE DISCLOSURE

The present disclosure relates to non-lethal and lethal projectiles and related launching mechanisms and accessories and more specifically, to those projectiles with an that may be energized or charged by a launcher and/or a launcher accessory and that may disintegrate after launch to deliver a payload.

BACKGROUND OF THE DISCLOSURE

Non-lethal projectiles and non-lethal launching systems are commonly used by law enforcement for purposes of crowd control, such as quelling a riot or angry mob or to individually subdue a suspect. Increasingly, they may find usage as another means to augment self-defense in situations such as a home invasion, for example. The projectiles and systems (such as weapons that are capable of delivering such non-lethal projectiles) are designed to subdue a target subject or subjects for a time without causing permanent harm. Typically, such weapons systems require a projectile to burst on impact with the suspect and thus require accurate targeting and, in some cases, cause severe injury to a suspect. The most common means for such a device is a projectile that bursts on impact or a targeting device tethered by wires which delivers a high voltage shock thus immobilizing the suspect. All of these existing means suffer from a number of disadvantages outlined in more detail below.

The use of high voltage electric shock has been around for a number of years. While it is fairly effective at immobilizing a suspect, it suffers from the drawbacks that cardiac arrest in the target/suspect may result due to the voltage imparted into the suspect's body. Additionally, in the case of a suspect who is not in an open or unconstrained environment, such means requires accurate targeting to ensure that the electrodes contact the individual in order to deliver the electric shock. Furthermore, the longest effective range for such a device is less than 30 feet and more typically 10 or 15 feet. Additionally, the effectiveness of such weapons can be inhibited by clothing, coats or wet environments.

A second technique involves the use of a paintball that is filled with a capsicum or PAVA powder. While this eliminates or improves on the range issues of the electric shock techniques, it requires accurate targeting of the suspect. This is extremely difficult to do in short range as the ricochet of the powder off of a suspect can cause it to come back to the user. Furthermore, upon impact, the control of the powder release is not necessarily effective and can be one dimensional, meaning that it has difficulty stopping a suspect who is running away—as the cloud is left behind. Additionally, if the impact does not burst the projectile, the intended effect is not achieved.

Another approach is to provide for a projectile, the rupture or separation of which is caused by components that are powered by a battery or batteries that is/are internal to the projectile. However, in that batteries are inherently respectively large and heavy when compared to a projectile, and therefore limit the potential configurations of the projectile (due at least to the fact that the batteries occupy a substantial amount of space within the projectile). Furthermore, batteries are relatively expensive, thereby driving up the cost of manufacture of such a projectile. Furthermore, and quite concerningly, batteries drain and lose charge over time, which means that a projectile so configured may not be in a usable state for firing if it has been on the shelf for a length of time. This drawback is not acceptable, as the conditions under which such projectiles are to be used requires that they be ready to fire at all times.

Lethal projectiles have also been developed that fragment into multiple pieces, thus increasing the effective radius of such a projectile (and lowering the requisite targeting precision). Such fragmentation may be caused by components that are powered by a battery or batteries that is/are internal to the projectile or by the actual impact on the target. However, in that batteries are inherently respectively large and heavy when compared to a projectile, and therefore limit the potential configurations of the projectile (due at least to the fact that the batteries occupy a substantial amount of space within the projectile). Furthermore, batteries are relatively expensive, thereby driving up the cost of manufacture of such a projectile. Moreover, and quite concerningly, batteries drain and lose charge over time, which means that a projectile so configured may not be in a usable state for firing if it has been on the shelf for a length of time. This drawback is not acceptable, as the conditions under which such projectiles are to be used requires that they be ready to fire at all times.

All of the currently available methods for non-lethal projectiles suffer from one or more of the following disadvantages: difficult to target, not suitable for close range, not suitable for long range, inaccurate, sometimes lethal and often otherwise not effective, costly to manufacture, complex in configuration, and not reliably powered. Furthermore, with regard to lethal projectiles, most currently available methods include the requirement that such a projectile must impact the target to be effective and heavy and complex battery arrangements for power and operation.

SUMMARY OF THE DISCLOSURE

In view of the foregoing disadvantages inherent in the prior art, the general purpose of the present disclosure is to provide a projectile construction (also referred to herein as "projectile" in context), projectile launcher, and launcher accessory that include all the advantages of the prior art, and overcomes the drawbacks inherent therein. As used herein, "payload" may refer to a substance, object, compound, or material that is capable of delivering a lethal or incapacitating force to and/or resulting in a lethal or incapacitating effect upon a target. Such a payload can be in powder, liquid or aerosol, or foam form and/or in the form of shrapnel (or a combination thereof) without departing from the spirit of the disclosure. The payload may comprise a debilitating material, a visible substance (such as a dye or a powder, for example) or an invisible marking substance (such as a UV-reactive material, for example) or a combination thereof. The projectile may also comprise an energy storage means. As used herein, "energy storage means" is a storage means that lacks sufficient energy (such as a charge, for example) to activate or arm the projectile or another component of the projectile until the energy storage means has been energized or re-energized by an outside source (such as a launcher or an accessory thereof). The minimum energy to activate or arm the projectile (or to imitate a reaction as described elsewhere herein) is referred to as the "threshold energy", meaning that at energy levels below the threshold energy, the projectile will not be armed or activated and/or cannot initiate a mechanical or chemical reaction. In an embodiment, the energy storage means comprises a capacitor, which capacitor may be charged or energized by the launcher or launcher accessory prior to or coincident with launching of the projectile.

In an embodiment, the projectile separates into two or more components after it leaves the barrel of a launcher to distribute a payload. In an embodiment, the separation can be initiated by electrical, mechanical or chemical means or by a combination thereof. In a still further embodiment, the time of initiation can be varied depending on the distance to the suspect or target. In an embodiment, the means of initiating separation of the projectile and the payload are disposed in separate compartments or regions of the projectile.

In another embodiment, an electrical circuit may be disposed within the projectile. In said embodiment, the projectile may comprise an energy storage means. The electrical circuit may either initiate a chemical reaction or otherwise cause a separation of the projectile through an electromechanical method, and the circuit may be activated by dynamic inductive activation. Dynamic induction, as used herein, is the charging or energization of a moving coil through the disruption of a static magnetic field. The charge or energization is dependent on the speed in which the coil disrupts the static magnetic field lines as shown in an exemplary embedment in FIG. 10. This form of induction differs from static induction, the latter being the charging of a stationary coil using a dynamic magnetic field.

In an embodiment the circuit and the payload are disposed in separate compartments or regions of the projectile. The release may be timed such that the separation and distribution of the payload is in proximity of the target. The timing may include calculations based on the projectile velocity as well as the distance to the target. The electrical circuit and reaction can be initiated when the energy storage means has been sufficiently charged or energized, i.e., beyond the threshold energy—such charging or energization being done by the launcher or outside source (such as, but not necessarily limited to, the launcher accessory), for example.

In a still further embodiment, the separation, opening, etc. of the projectiles is a result of a chemical reaction, an activating compound such as nitrocellulose may be initiated with an "electric match". The electric match may consist of a nichrome or similar high resistance wire that is coated with a pyrogen and is initiated with electrical energy such as from a battery. capacitor, or the like. In an embodiment, wherein the launcher and/or launcher accessory comprises at least one magnet, when the projectile is launched, the at least one magnet of the launcher and/or accessory can activate the electric match by dynamic induction. In an embodiment, the electric match and the payload are disposed in separate compartments or regions of the projectile.

In a still further embodiment, the projectile launcher (and/or launcher accessory) and the projectile are part of a system in which the projectile is encoded with timing and or distance information as a result of range to target. The projectile launcher and/or launcher accessory may further include a range finder or other means for measuring distance to a target. In a further embodiment, the energy storage means is energized with a specific amount of energy which corresponds to a target's distance from the user. In other words, the amount of energy supplied to the projectile is determined by the launcher/launcher accessory (such as a range finder of the launcher or launcher accessory). The launcher/launcher accessory codifies the distance information and charges or energizes the energy storage means with a specific amount of energy, said specific amount of energy is decoded by a projectile control circuit which control circuit determines the distance at which the projectile should rupture etc. The launcher (and/or launcher accessory) and projectile can be configured to be in wired or wireless communication with each other, and the launcher and/or launcher accessory may also be capable of transferring energy to the projectile. In an embodiment, the launch of the projectile by the launcher can be accomplished by compressed air, in which embodiment the requirement for complex firing mechanism (such as a primer on the projectile or a hammer for the launcher) is eliminated. However, it will be apparent that the projectile and launcher herein may be configured to be launched by combustion or other means.

DESCRIPTION OF THE DRAWINGS

The advantages and features of the present disclosure will become better understood with reference to the following detailed description and claims taken in conjunction with the accompanying drawings, wherein like elements are identified with like symbols, and in which:

DETAILED DESCRIPTION OF THE DISCLOSURE

Figure 1:
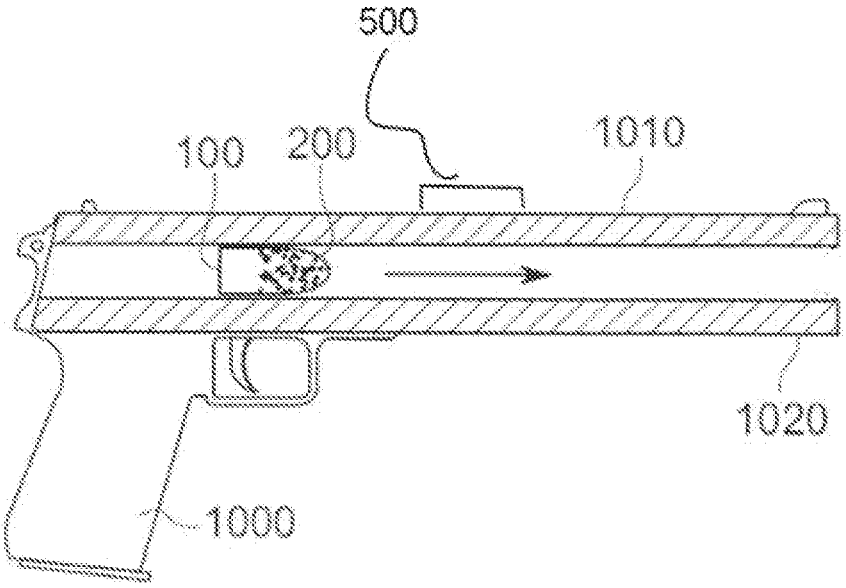
FIG. 1 is a longitudinal cross-sectional view of a projectile launcher 1000 with a projectile, according to an exemplary embodiment of the present disclosure.

The exemplary embodiments described herein detail for illustrative purposes are subject to many variations in structure and design. It should be emphasized, however, that the present disclosure is not limited to a particular projectile or projectile launcher as shown and described. That is, it is understood that various omissions and substitutions of equivalents are contemplated as circumstances may suggest or render expedient, but these are intended to cover the application or implementation without departing from the spirit or scope of the claims of the present disclosure. The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present disclosure provides for a projectile 100 and a launcher 1000, and, in an embodiment, a launcher accessory 1100. The projectile 100 preferably comprises a payload 200 for immobilizing and/or marking a target or suspect. It will be understood that payload as used herein may also comprise a substance, object, compound, or material that is capable of delivering a lethal or incapacitating force to and/or resulting in a lethal or incapacitating effect upon a target The projectile 100 preferably comprises an enclosure, which enclosure may be formed by an at least partially annular-shaped shell 102. The shell may include a closed, substantially planar end portion 104 (also referred to herein as "end cap") that corresponds to a radius of the annular portion of the shell to form the enclosure. The shell and end portion may individually and collectively refer to herein as a housing of projectile 100. It will be apparent that the projectile housing is not limited to the shell and end portion configuration mentioned in the preceding exemplary embodiment, and that the projectile housing may comprise any shape that forms an enclosure without deviating from the spirit of the disclosure, such as, but not necessarily limited to a sphere or a cone. The payload 200 is preferably contained in the enclosure prior to launch of the projectile 100. In an embodiment, the projectile 100 comprises an aperture, which aperture can be temporarily sealed with an end cap 104, to seal the projectile until activation of the projectile during/after launch.

In an embodiment, the projectile 100 is capable of self-separating, disintegrating or otherwise opening prior to impact with a target or other impact surface. In an embodiment, the launcher 1000 is capable of initiating separation or disintegration or rupturing or opening, etc. of the projectile 100. In an embodiment, the launcher 1000 is capable of communicating to the projectile 100 and or arming a projectile 100 prior to or coincident with projectile launch. In another embodiment, the launcher comprises a safety and/or trigger, which safety and/or trigger, until activated, prevent the projectile from becoming armed. The arming can be, for example, the charging or energization of an energy storage element or means contained within the projectile.

Figure 1A:
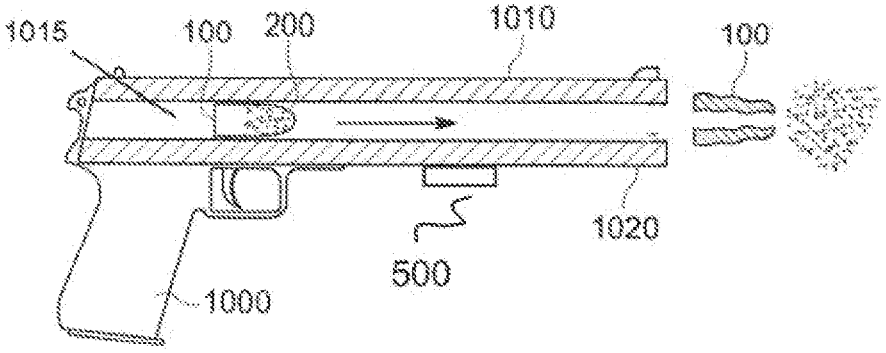
FIG. 1A is a view of the barrel of a projectile launcher and at least one magnet of the launcher.

An exemplary launcher 1000 is shown in FIG. 1A. The launcher comprises a barrel 1010 for directing and launching a projectile 100. The launcher 1000 may also comprise a chamber 1015 for holding a projectile prior to firing thereof. It will be apparent that the launcher 1000 shown in FIG. 1A may be in other configurations so long as the launcher 1000 is capable of firing a projectile 100 of the projectiles disclosed herein.

Figure 2:
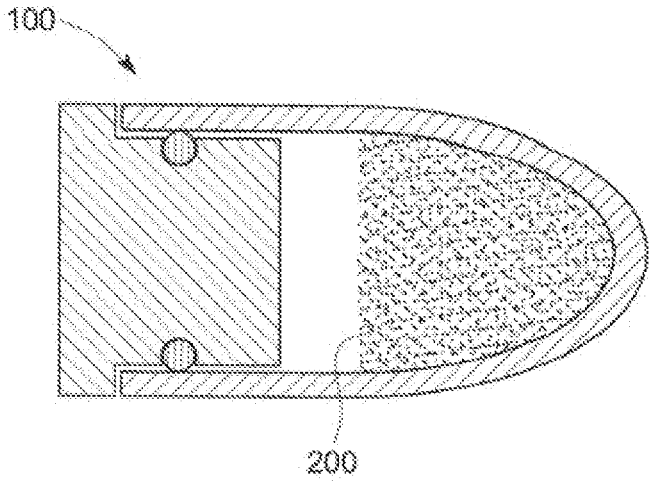
FIG. 2 are views of a projectile both before launch and then during flight in which the housing of the projectile has separated and released a payload, in accordance with an exemplary embodiment of the present disclosure.
Figure 2:
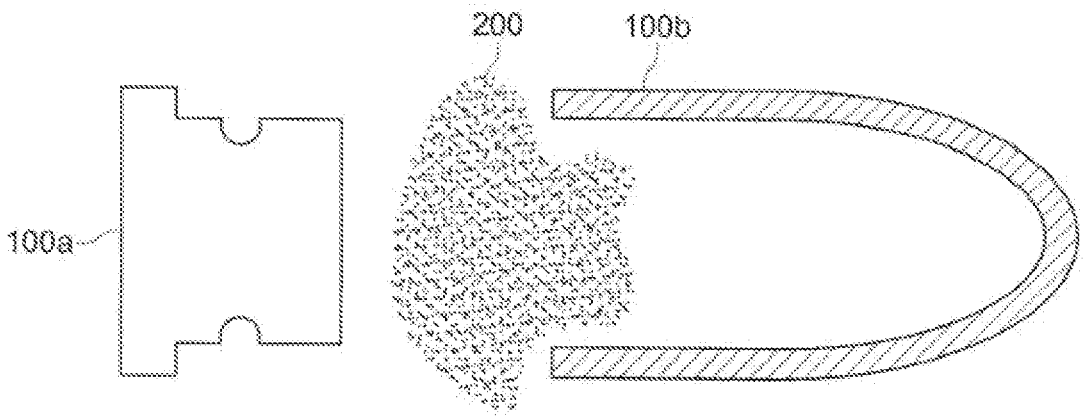

In an embodiment such as is shown in FIG. 2, the projectile 100 housing opens or otherwise separates after it leaves the barrel 1010 of a launcher 1000 to distribute a payload. That is, the rupturing or breaching of the projectile housing or the separation of housing components creates an opening in the projectile 100 out of which the payload 200 may emanate.

In another embodiment the projectiles 100 disclosed herein include various means of adjustment of the aforementioned embodiments in which the release or dispersion of the payload 200 occurs at fixed or predetermined distances from the barrel 1010 of the launcher 1000 and/or launcher accessory 1100.

Figure 8:
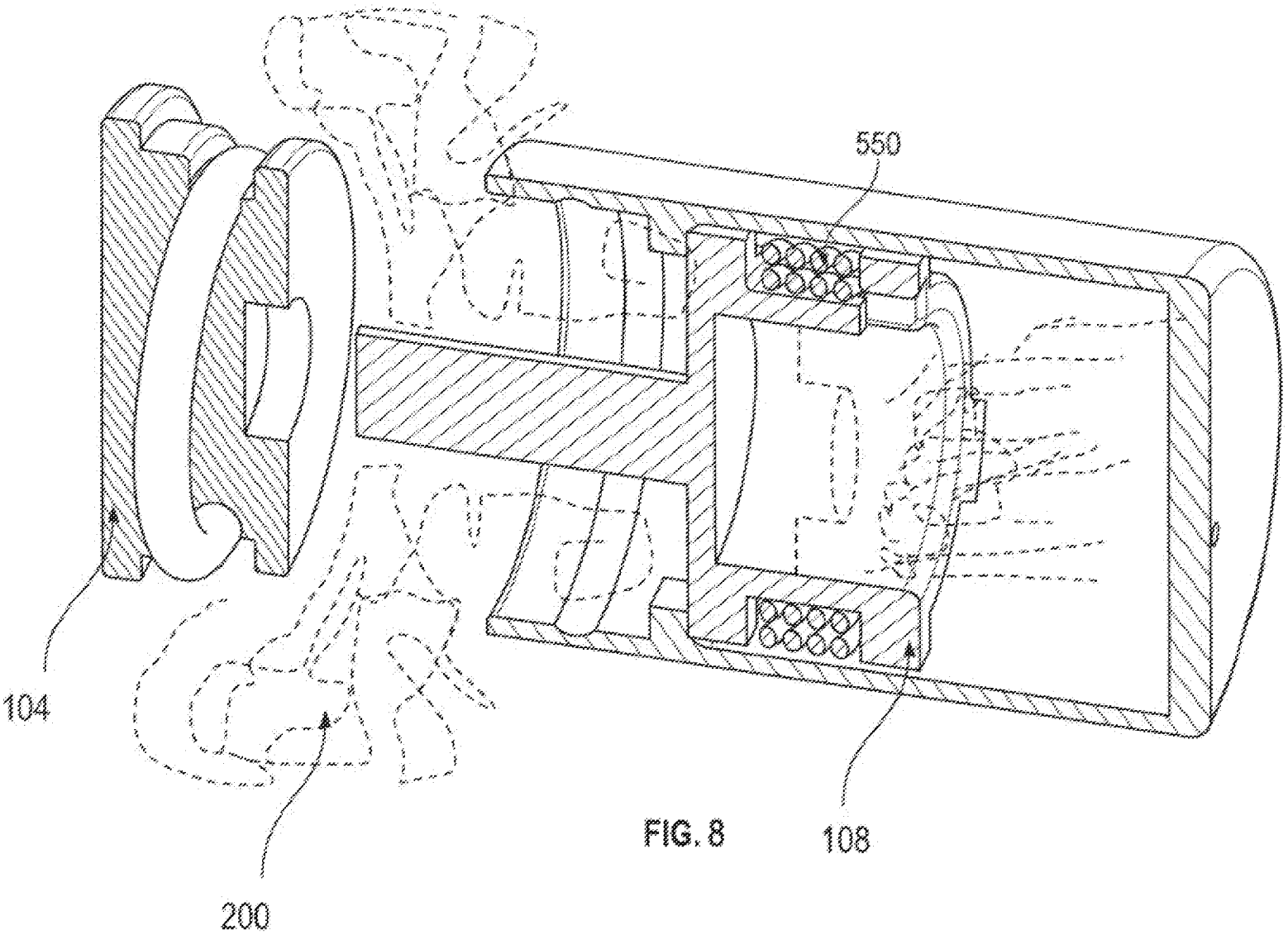
FIG. 8 shows a projectile in which the housing of the projectile has separated by a ram and has released a payload, in accordance with an exemplary embodiment of the present disclosure.
Figure 10:
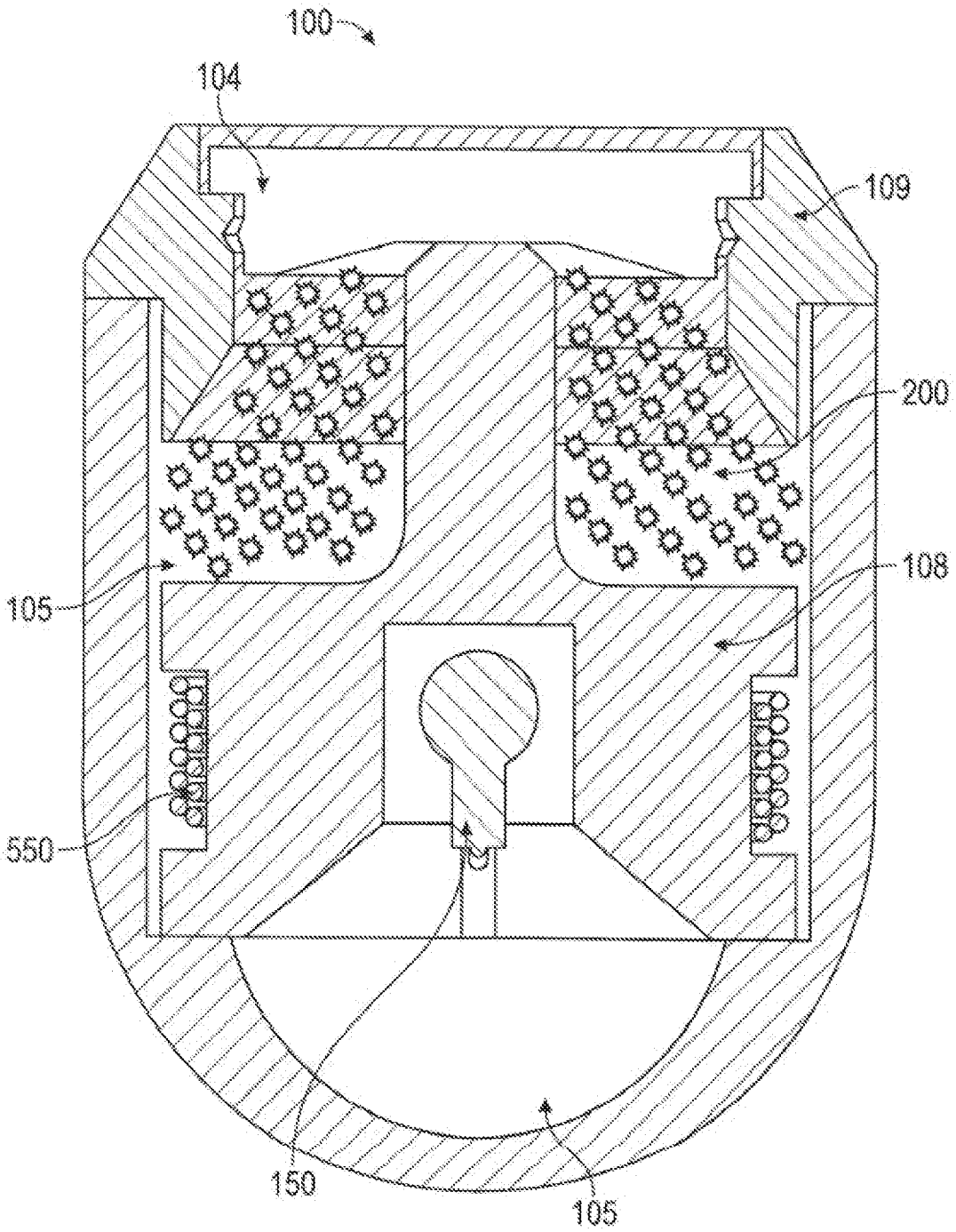
FIG. 10 shows a view of projectile with plurality of compartments as well as various components thereof, in accordance with an exemplary embodiment of the present disclosure.
Figure 11:
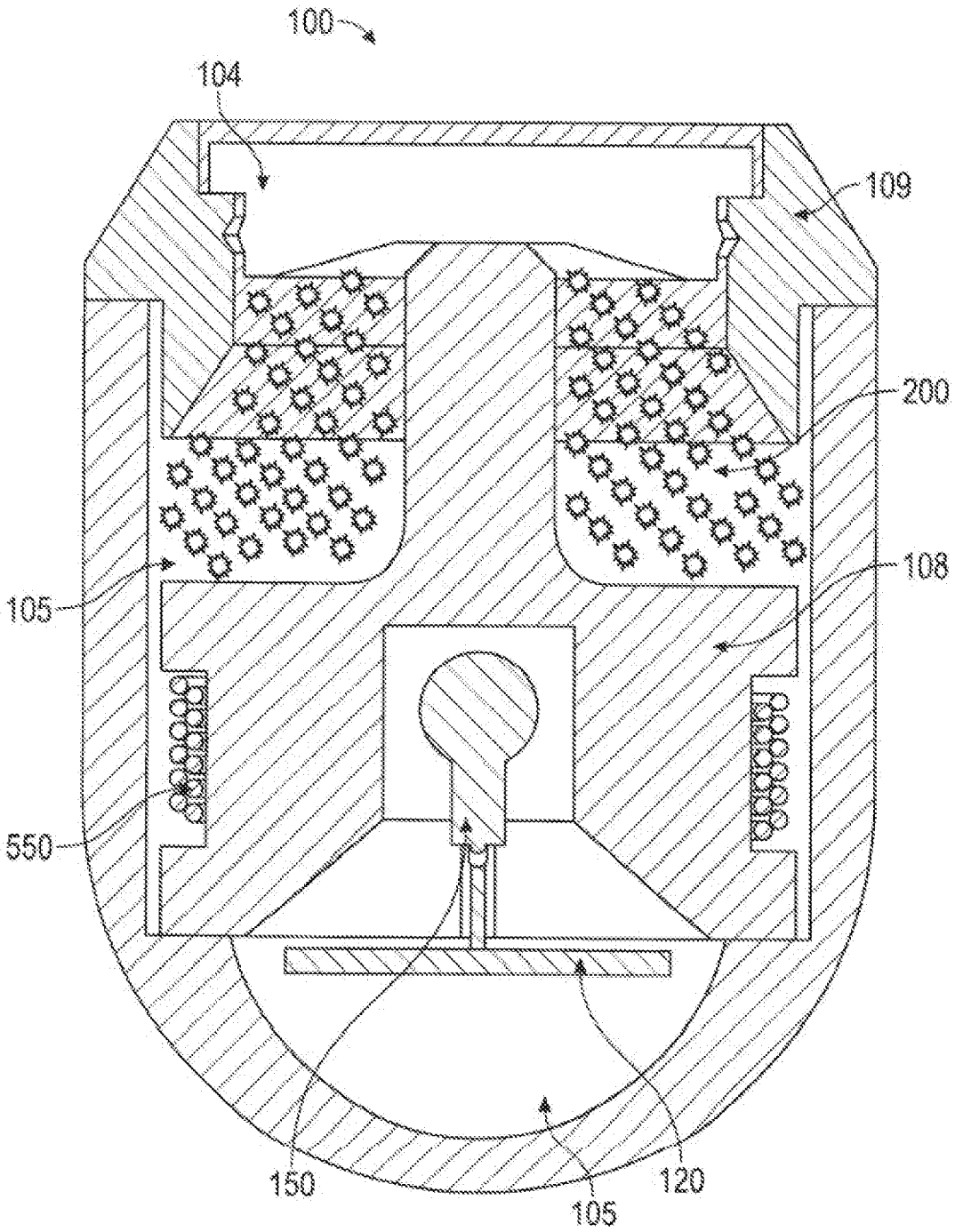
FIG. 11 shows another view shows a projectile with plurality of compartments as well as various components thereof, in accordance with an exemplary embodiment of the present disclosure.

In another embodiment, the release may be accomplished by a control circuit 120. Such a control circuit 120 may include a radio-frequency identification (RFID), where an RFID tag in the projectile 100 may cause the projectile 100 to rupture at a user-specified distance from the launcher 1000 or launcher accessory 1100. Said rupturing may be caused by initiating a reaction with nitrocellulose for example. In such an embodiment, it will be apparent that the launcher 1000 and launcher accessory 1500 may comprise a transmitter or other means for communicating with the RFID tag or the reaction may be controlled by other means. In another embodiment, the control circuit 120 is inductively activated. In an embodiment, and as shown in FIGS. 8, 10 and 11, the projectile may comprise a plurality of compartments 105 to sequester the payload from the other components of the projectile until separation, rupturing, opening, etc. of the projectile is imminent.

In another embodiment, the energization of the energy storage means is accomplished via dynamic induction. In such an embodiment, the projectile comprises a coil 550 of wire, and the launcher comprises a magnetic element. The coil is operatively coupled to the magnetic element. In a preferred embodiment, the magnetic element is disposed in the vicinity of the barrel of the launcher. The magnetic element is capable of producing a static magnetic field. In an embodiment, magnetic element is at least one magnet 500. It is understood that the projectile (and the coil 550 of wire comprised therein) has a known velocity as it travels down the barrel and through the static magnetic field. In this manner, an energy is induced within the coil 550 of wire, which energy can be harnessed, for example, to energize the energy storage means. This energization by dynamic induction occurs only when the projectile is moving through the barrel with a sufficient threshold velocity (defined herein as the velocity required such that the energy induced in the coil 550 exceeds the threshold energy). This provides an inherently safe way to activate the projectile, i.e. the projectile can only be activated during launch and said launch must provide the projectile with enough velocity to exceed the threshold velocity.

Figure 9:
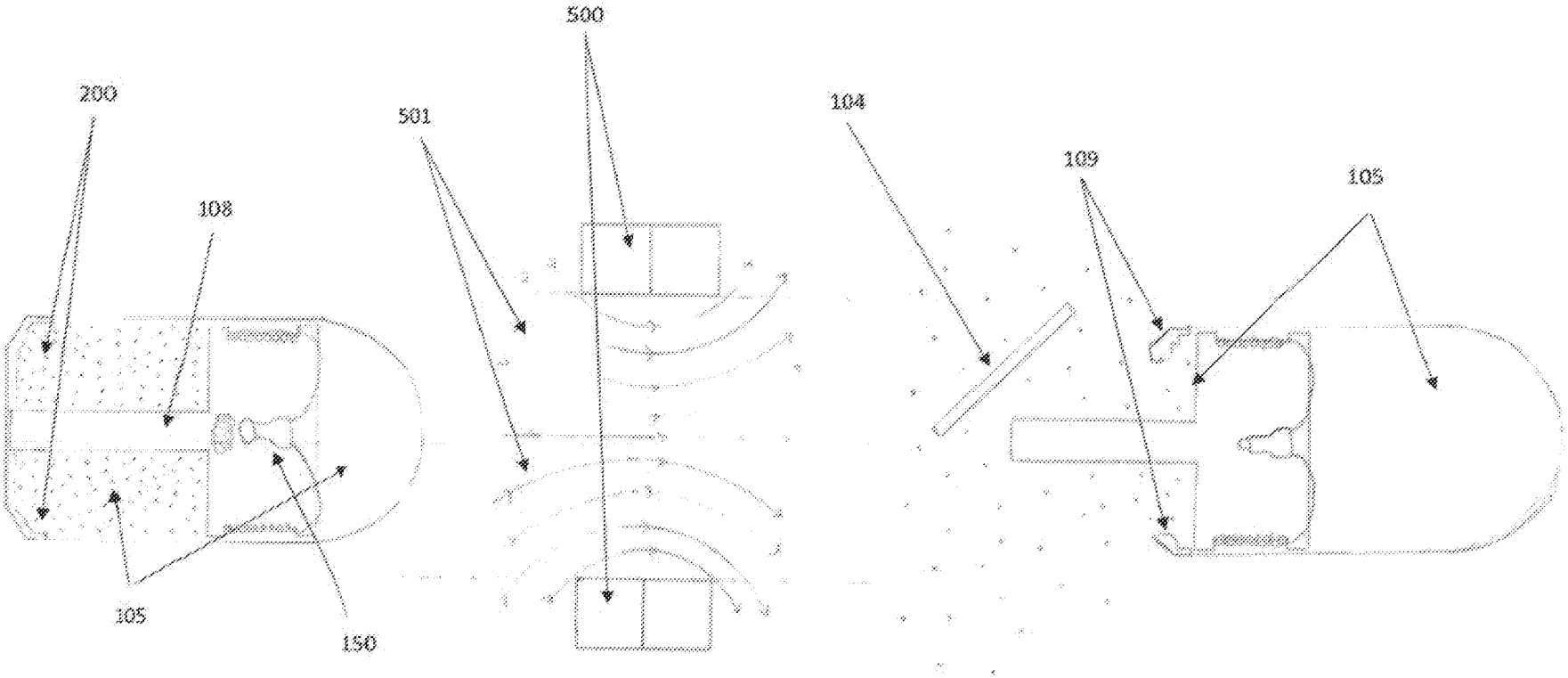
FIG. 9 shows a projectile's movement through a static magnetic field, and the activation of said projectile due to the energization of the energy storage means by dynamic induction in accordance with an exemplary embodiment of the present disclosure.

Referring further to FIGS. 7, 8, 10 and 11, a multi-compartment 105 projectile is shown in accordance with an exemplary embodiment of the present disclosure. In this exemplary embodiment, the payload is maintained in a compartment 105 that is different than the compartment 105 in which the initiator 150 and/or activating material is maintained. By keeping these elements physically separated until the projectile separation, opening, rupturing, etc. sequence commences, the integrity of the sequestered elements is maintained. In an embodiment, and as shown in FIGS. 7, 8, 10, and 11 for example, the separation is created by a ram 108. The ram 108 is movable within the housing of the projectile in such an embodiment such that when the activating element or material (such as an electric match or nitrocellulose activates, the ram 108 is moved by the force of the activating element or material. In an embodiment, the ram 108 is proximate to a portion of the interior of the shell such that the movement of the ram 108 caused by the activating element or material contacts and causes the shell to separate, rupture, open, etc. such that the payload may be released from the shell. In such an embodiment, the payload may also be proximate to the region of the shell that is contacted by the ram 108 and/or that is opened by the ram 108. An exemplary opening of the projectile is shown in FIG. 9 in which a moving projectile 100 has disrupted the static field lines 501 (being generated by a magnetic element/s 500) to activate the initiator 150, which accelerates the ram 108, such that the end cap 104 is ejected, and the payload 200 is thereafter dispersed. Stoppers 109 may be provided to ensure that the ram 108 does not eject with the payload 200 and end cap 104.

Figure 3:
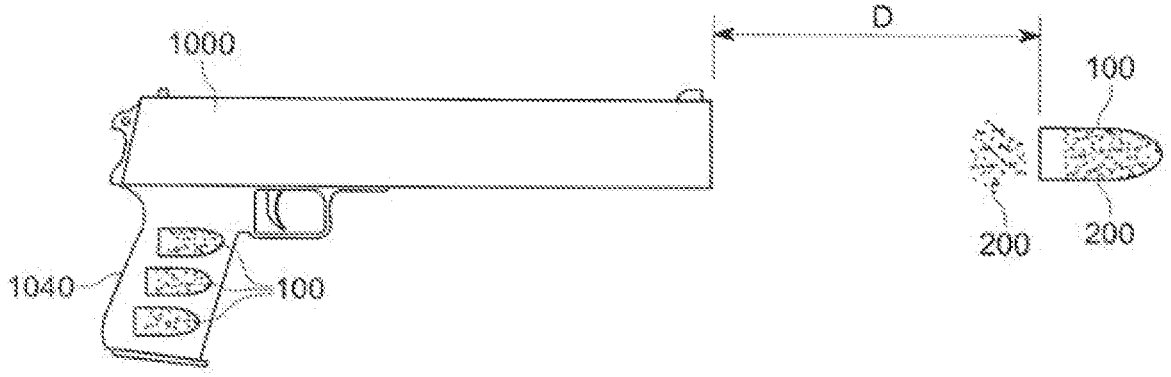
FIG. 3 is a view of a projectile launcher with a magazine in which the projectiles are set to rupture at various times/distances after launch, in accordance with an exemplary embodiment of the present disclosure.

As shown in FIG. 3, the launcher and projectile system may comprise a magazine 1040 that holds a plurality of projectiles 100 and that feeds said projectiles 100 to the launcher 1000 for firing/launching the projectiles 100. In an embodiment, the various projectiles 100 of the magazine 1040 may be configured to separate or rupture, etc. at the same distance "D" or time after launch, or they may be configured to separate or rupture, etc. at different distances and/or times after launch. In the embodiment where the various projectiles are configured to separate or rupture, etc. at the same distance "D" or time after launch, it will be apparent that a user may concentrate the effect of the payload from the ruptured projectiles within a certain defined area. In an embodiment where the various projectiles are configured to separate or rupture, etc. at different distances and/or time after launch, it will be apparent that the particular distance and/or time after launch at which the separation, etc. of each particular projectile of the various projectiles may be accomplished by selectively setting the separation, etc. of each projectile of the various projectiles as elsewhere set forth herein.

Figure 4:
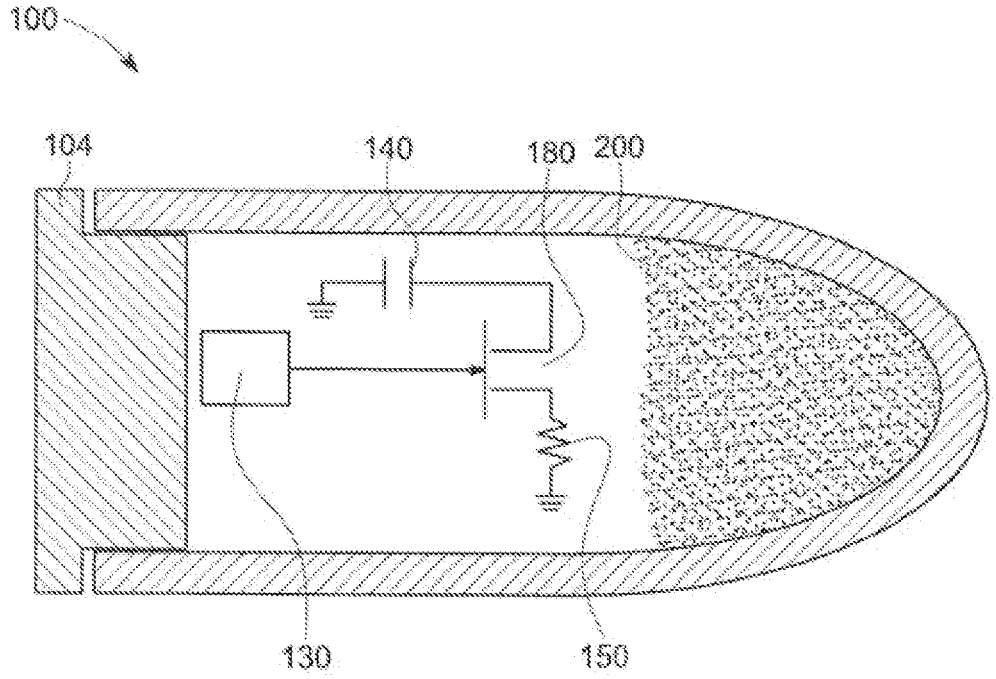
FIG. 4 is a view of a projectile comprising a payload, a control circuit, an initiator, and an energy storage means, in accordance with an exemplary embodiment of the present disclosure.

Referring to FIG. 4, the projectile 100 may further comprise an energy storage means 140 (such as, but not limited to: a capacitor or a miniature Lithium ion rechargeable battery) and an initiator 150 (such as, but not limited to, a heating element). As used herein, "energy storage means" is a storage means that lacks a sufficient charge or energization to activate or arm the projectile or another component of the projectile until the energy storage means has been charged or energized by an outside source (such as a launcher, said launcher comprising an electrical, magnetic, and/or electromagnetic source) beyond a threshold energy. The charging of the energy storage means may also be referred to herein as "energizing" the energy storage means. The energy storage means disclosed herein may also be referred to as an energizable energy storage means. The energy storage means 140 and initiator 150 may be operatively coupled to a switch 180, and the timer 130 may cause the switch 180 to trip at a particular time after launch of the projectile 100, after which the energy storage means 140 may deliver stored energy to the initiator 150 to cause the initiator 150 to perform a reaction (such as heating) that results in the projectile 100 opening, separating or disintegrating to release the payload 200 In an embodiment, the energy storage means is energized by the at least one magnet 500 of the launcher and/or the at least one magnet 1500 of the launcher accessory coincident with launch of the projectile as described elsewhere herein. In an embodiment, the energy storage means is disposed in a compartment 105 of the projectile that is separate from the compartment 105 of the projectile in which the payload is disposed.

Figure 5:
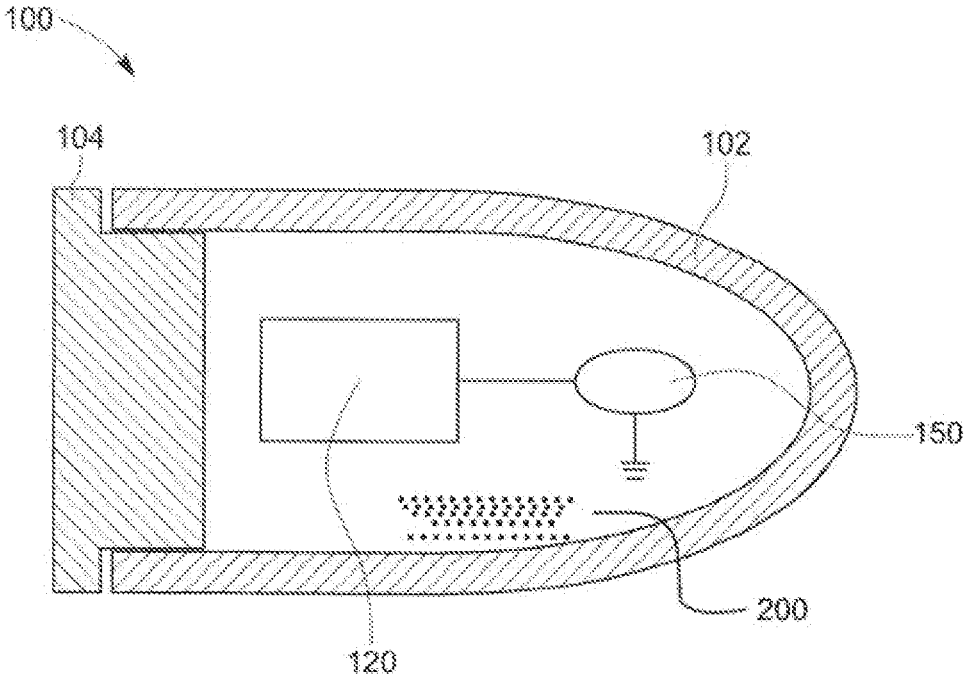
FIG. 5 is a view of a projectile comprising a payload, an initiator, and a control circuit, in accordance with an exemplary embodiment of the present disclosure.

In another embodiment, and referring to FIG. 5, the control circuit 120 is directly coupled to the initiator 150 such that the control circuit 120 permits operation by the initiator 150 after the initiator 150 or control circuit 120 has been activated by inductive energy from the coil 550 of the projectile 100. As shown in FIG. 5, the initiator 150 may be an electric match, which electric match may heat upon activation to create an opening in the shell of the projectile 100 to release the payload 200. It will be apparent that the control circuit 120 may be activated by the at least one magnet 500 of the launcher and/or the at least one magnet 1500 of the launcher accessory. In said embodiment, the initiator 150 will initiate opening of the projectile shortly after exiting the launcher. This would be desirable in a short-range situation, for example.

In an embodiment, the projectile comprises a plurality of compartments 105 within the housing of the projectile. Such a configuration is shown in an exemplary embodiment in FIG. 7. In such an embodiment, the payload may be physically sequestered from the initiator 150, energy storage means, and or control circuit 120. This sequestration allows for more effective functioning of these various components. For instance, if the payload is a powder, the sequestered powder will not be able to coat and degrade the nitrocellulose. Similarly, sequestration prevents the activating elements from inadvertently igniting or burning the payload prior to separation, opening, etc. of the projectile. In an embodiment, a plurality of compartments 105 is formed by a ram 108 element that is disposed within the projectile. The ram 108 may be in a temporarily-fixed position within the projectile but may also be capable of movement within the projectile when subjected to a force.

In an embodiment, activation of an activating element imparts a force on the ram 108, causing the ram 108 to strike a portion of the interior of the housing with sufficient force of its own to break, rupture, or otherwise open a portion of the housing such that the payload may disperse from the projectile. In an embodiment, the projectile is, after loading with components and payload, sealed shut with an end cap 104. In such an embodiment, the ram 108 may strike the end cap 104 to open the projectile after the ram 108 has been subjected to the force of the activating element.

Figure 6:
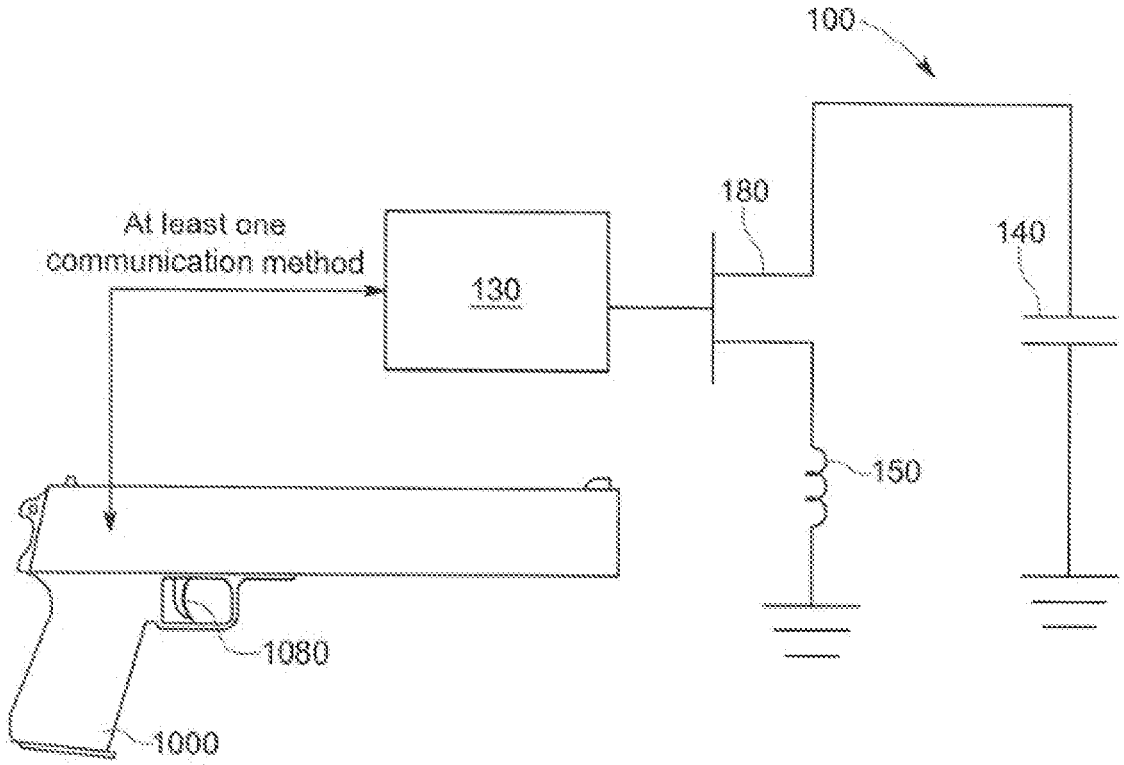
FIG. 6 shows a launcher, components of a projectile and at least one means of communicating information to the projectile, in accordance with an exemplary embodiment of the present disclosure.
Figure 7:
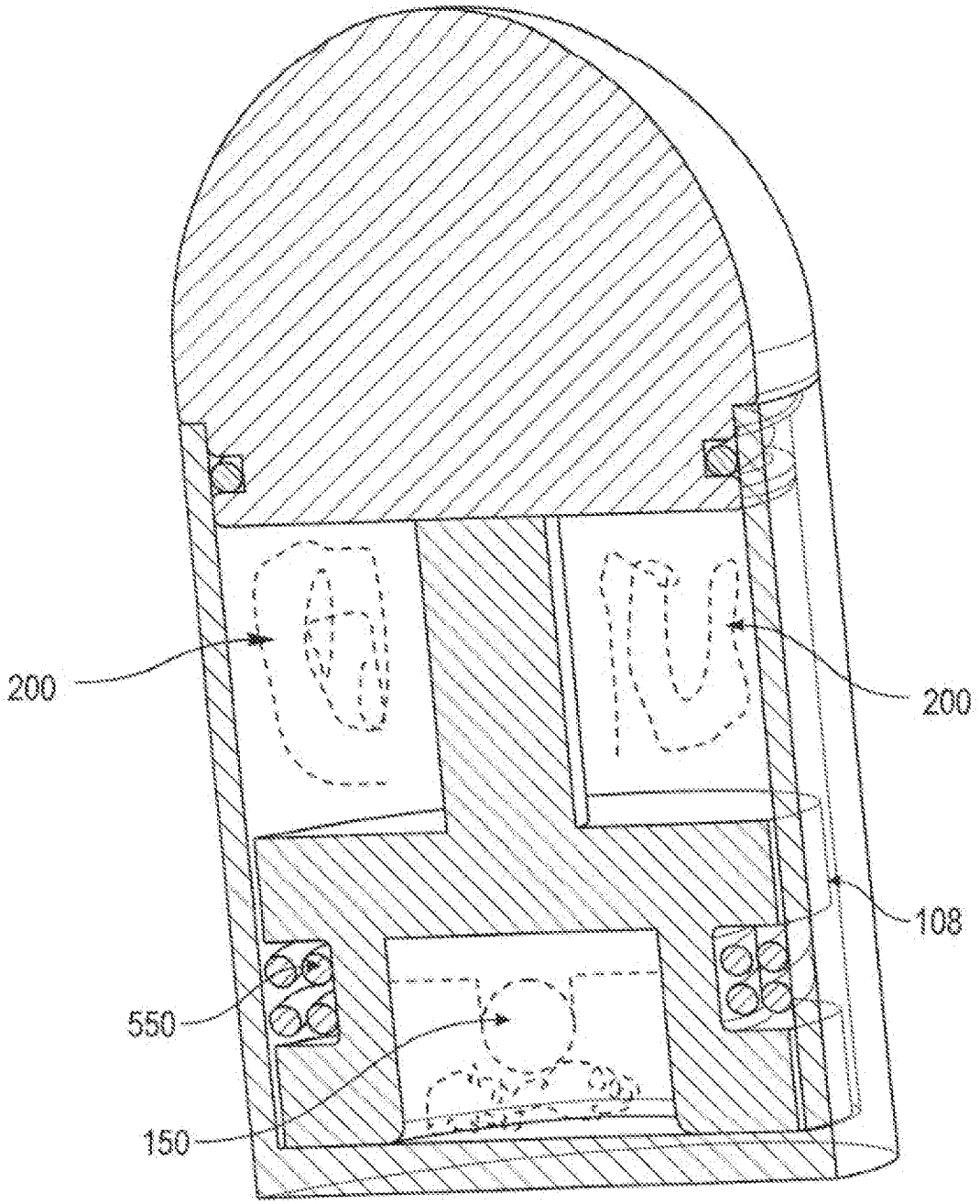
FIG. 7 shows a projectile with a plurality of compartments and a ram for facilitating the opening, rupture, separation, etc. of the projectile, in accordance with an exemplary embodiment of the present disclosure.

In still another embodiment, and as shown for example in FIG. 6 the projectile 100 and the launcher 1000 communicate through at least one of a wireless or wired means. This allows the launcher to set parameters within the projectile allowing for more precise control of the point at which the housing is breached or ruptured, i.e. to set a particular distance or time at which the projectile may rupture.

The launcher 1000 may comprise a trigger 1080 to initiate the launch process. It will be apparent that the charging or the energization of the energy storage means by the launcher and/or launcher accessory eliminates the requirement that the energy storage means comprise a self-contained power source (i.e., a battery for the energy storage means is not required), thereby eliminating the possibility that the energy storage means will suffer a power drain prior to launch.

FIG. 1 represents a projectile launcher 1000 that is preferably based on electrical-driven or a combination of electrical and combustion or compressed gas means. It is understood that the projectile is not limited to a particular launching method but a preferable designed-launcher in which the advantages of having an electronic control and communication element with the projectile can be used. In an embodiment, the projectile herein is of lightweight construction (for at least the reason that it does not require an internal battery), such that compressed gas can sufficiently and effectively launch the projectile. However, the disclosure may, in other embodiments include, a primer and/or propellant on the projectile and a hammer of the launcher to strike such primer, as well as other means of launching the projectile other than by way of compressed gas. Because the projectile is energizable by the launcher (such as by the at least one magnet or magnetic element of the launcher) or other outside source, the possibility that the projectile would fail to operate due to draining of an internal battery is rendered moot. This energization scheme also eliminates the possibility that a projectile might ignite prior to launch.

The projectile, launcher, and launcher accessory disclosed herein offer the advantages of more controlled release of payload than existing solutions can offer. For instance, a user can set the range and/or rate at which the material is released by configuring parameters that control the opening in the projectile. The projectile further does not require impact upon a target. Configuration of the shell of the projectile disclosed herein may also increase accuracy of flight of the projectile to further improve the safety of use of the projectile disclosed herein. Furthermore, the projectile can be kept in an unarmed state until the projectile is launched from the launcher. The charging or energization of the energy storage means by the launcher or other outside source eliminates the possibility that the projectile will suffer from power loss or failure prior to firing.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A launcher and projectile system, the system comprising a launcher, a projectile, said projectile comprising a housing, said housing comprising at least one compartment, an energizable energy storage means, a payload, a control circuit, an initiator, and a ram element, wherein one compartment of the at least one compartments contains said payload, wherein said energizable energy storage means is at least partially energized by the launcher, wherein said ram element sequesters said initiator from said payload before, during, and after activation of the initiator, and wherein after launch of said projectile, said initiator is initiated to cause the projectile housing to rupture, disintegrate, separate or otherwise have an opening created through which the payload is released.

2. The projectile of claim 1, wherein said ram element is stationary until initiation of said initiator, upon which initiation said ram element moves to create an opening in the projectile housing.

3. A projectile, said projectile comprising a housing, said housing comprising at least one compartment, an energizable energy storage means, a payload, a control circuit, an initiator, and a ram element, wherein said ram element sequesters said initiator from said payload before, during, and after activation of the initiator, wherein one compartment of the at least one compartments contains said payload, wherein said energizable energy storage means is at least partially energized by a source outside of the projectile.

4. The projectile of claim 3, wherein said ram element is stationary until initiation of said initiator, upon which initiation said ram element moves to create an opening in the projectile housing.

5. A projectile, said projectile comprising a housing, said housing comprising at least one compartment, a coil of wire, a payload, an initiator, and a ram element, wherein one compartment of the at least one compartments contains said payload, wherein said coil of wire is at least partially energized by a magnetic source outside of the projectile, wherein said ram element sequesters said initiator from said payload before, during, and after activation of the initiator, and wherein after launch of said projectile, said initiator is initiated to cause the projectile housing to rupture, disintegrate, separate or otherwise have an opening created through which the payload is released.

6. The projectile of claim 5, wherein said ram element is stationary until initiation of said initiator, upon which initiation said ram element moves to create an opening in the projectile housing.

* * * * *